US010562683B2

(12) United States Patent
Luzzato

(10) Patent No.: US 10,562,683 B2
(45) Date of Patent: Feb. 18, 2020

(54) STOPPER FOR A CONTAINER NECK

(71) Applicants: NOVEMBAL USA INC., Edison, NJ (US); Michel Luzzato, Ecully (FR)

(72) Inventor: Michel Luzzato, Ecully (FR)

(73) Assignee: Novembal USA Inc., Edison, NJ (US)

( * ) Notice: Subject to any disclaimer, the term of this patent is extended or adjusted under 35 U.S.C. 154(b) by 177 days.

(21) Appl. No.: 15/569,826

(22) PCT Filed: Apr. 27, 2016

(86) PCT No.: PCT/EP2016/059406

§ 371 (c)(1),
(2) Date: Oct. 27, 2017

(87) PCT Pub. No.: WO2016/174089

PCT Pub. Date: Nov. 3, 2016

(65) Prior Publication Data

US 2018/0141727 A1 May 24, 2018

(30) Foreign Application Priority Data

Apr. 28, 2015 (FR) ..... 15 53816

(51) Int. Cl.
*B65D 41/34* (2006.01)
*B65D 49/12* (2006.01)
*B65D 47/10* (2006.01)

(52) U.S. Cl.
CPC ..... *B65D 49/12* (2013.01); *B65D 41/34* (2013.01); *B65D 47/10* (2013.01); *B65D 2101/0023* (2013.01)

(58) Field of Classification Search
CPC .... B65D 41/3457; B65D 51/00; B65D 49/12; B65D 47/10; B65D 39/0052; B65D 17/40; B65D 43/22; B65D 39/00; B65D 41/3428

(Continued)

(56) References Cited

U.S. PATENT DOCUMENTS 3,462,035 A * 8/1969 Grussen ..... B65D 41/485 215/253
3,858,742 A * 1/1975 Grussen ..... B65D 41/485 215/253

(Continued)

FOREIGN PATENT DOCUMENTS

FR 2 908 746 5/2008

OTHER PUBLICATIONS

International Search Report from corresponding PCT Application No. PCT/EP2016/059406 dated Jun. 3, 2016 (6 pages)—in French.

*Primary Examiner* — J. Gregory Pickett
*Assistant Examiner* — Tia Cox

(57) ABSTRACT

A stopper for a container neck, comprising: a skirt having a generally tubular shape and being centered on an axis, the skirt being adapted to surround a neck of a container, and being provided internally with a snap-on member adapted to fasten the skirt to the neck in a removable manner by jamming the snap-on member with an external projecting boss of the neck of the container; and an opening strip having a generally annular shape and including a peripheral portion that is permanently connected to a peripheral portion of the skirt, the strip being movable relative to the skirt between: a first position, in which the strip surrounds an external lateral surface of the skirt, by providing an annular space radially between the external lateral surface of the skirt and an inner surface of the strip; and a second position, in which the inside of the strip is substantially detached from the skirt in order to enable the strip to be manually grasped so that the skirt is unsnapped from the neck.

18 Claims, 3 Drawing Sheets

(58) Field of Classification Search
USPC ... 215/305, 252–4, 258, 321, 304, 256, 224, 215/299, 260, 395–6, 399, 307, 250, 322, 215/43–4, 901, 346, 341, 316, 200, 364, 215/355, 270, 805, 752, 741, 754–5, 215/758–9, 775, 778, 265, 213, 276
See application file for complete search history.

(56) References Cited

U.S. PATENT DOCUMENTS

| | | | | | |
|---|---|---|---|---|---|
| 3,865,268 | A * | 2/1975 | Coop | B65D 41/44 | 215/253 |
| 3,866,782 | A | 2/1975 | Westfall | | |
| 5,464,112 | A * | 11/1995 | Guillot | B65D 41/485 | 215/213 |
| 5,762,217 | A * | 6/1998 | Ohmi | B65D 41/485 | 215/253 |
| 6,116,444 | A * | 9/2000 | Bosl | B65D 41/485 | 215/253 |
| 7,578,404 | B2 * | 8/2009 | Ekkert | B65D 41/3457 | 215/252 |
| 2003/0136753 | A1 | 7/2003 | Biesecker | | |
| 2013/0161327 | A1 * | 6/2013 | Lepage | B65D 51/243 | 220/270 |

* cited by examiner

STOPPER FOR A CONTAINER NECK

CROSS-REFERENCE TO RELATED PATENT APPLICATIONS

This is a National Phase of International Application No. PCT/EP2016/059406, filed Apr. 27, 2016, which claims the benefit of European Application No. 1553816, filed Apr. 28, 2015. The entire contents of the above-referenced applications are expressly incorporated herein by reference.

TECHNICAL FIELD

The present invention relates to a stopper for a container neck.

BACKGROUND

The invention generally relates to stoppers, typically made of plastic, comprising a tubular skirt designed to surround the neck of a container to be stoppered, and to be fastened thereto in a removable manner by jamming with at least one inner snap of this skirt having an external projecting boss of the neck. These stoppers are generally called "snap-on" stoppers. They are also sometimes called clip-on stoppers.

This type of stopper is basically less difficult to detach from a container neck than are screw stoppers, the latter having to be drawn while rotating about themselves with respect to the neck in order to be able to open and close them. However, by nature, "snap-on" stoppers have a certain resistance to opening, which must be overcome in order to unsnap them, i.e., release them relative to the neck. To more easily apply a corresponding effort to draw the stopper in order to open it, it is known how to provide the external surface of the skirt with a boss to be grasped by a user with one finger. FR-A-2 908.746 provides such an example. However, even with the aid of such a tab, manipulating these stoppers in order to open them is difficult, especially for certain users who may have difficulty grabbing the skirt with sufficient firmness in order to unsnap it from the neck. Moreover, this difficulty may be more apparent during initial opening of stoppers incorporating means for evidencing this initial opening and designed to be broken by a user wishing to unsnap the skirt for the first time.

US 2013/0161327 proposes the use of an annular opening strip to make it easier to open a "snap-on" stopper. Part of this opening strip is permanently connected to the skirt of the stopper by a hinge allowing for toggling the opening strip between a position folded down against the skirt and an unfolded position in relation to the skirt. In the folded-down position, the opening strip is pressed horizontally against the upper end of the skirt, except in the last embodiment, in which the opening strip girds the skirt, i.e., a top part of the skirt, whose outside diameter is less than that of a lower part of the skirt, remains radially distant from the opening strip, whereas the aforesaid lower part is enclosed by the opening strip, while being connected to the lower end edge of the latter by the hinge. This solution makes it necessary to maintain the level of the lower end edge of the opening strip above that of the lower end edge of the skirt, whereby the offset between these two levels makes it possible to accommodate the hinge.

This means that anti-tampering safety is low, in the sense that it is easy to use a tampering tool to unsnap the skirt locally without damaging or moving the retaining strip in the folded-down position and the hinge.

The aim of the present invention is to propose a "snap-on" stopper, which, while being easy to manufacture and place on a container neck, is both easy to open, even in the case where the stopper incorporates tamper-evident means, and difficult to defeat.

Thus, the object of the invention is a stopper for a container neck, as defined in Claim 1.

BRIEF SUMMARY

One of the ideas upon which the invention is based is to incorporate into a "snap-on" stopper an opening ring that the user may easily grab manually, in particular by slipping it around one or two fingers in order to pull the skirt, until it "snaps off" from the neck, i.e., releasing it from the neck, while overcoming the resistance to its jamming around the collar. This opening ring is realized by a strip in the form of loop, closed on itself and connected in a non-frangible way to the skirt only in one area restricted by their respective periphery. As long as the ring was not used to open the stopper, it is designed to surround at a distance an external lateral surface of the skirt, while being connected to the latter by frangible tamper-evident bridges, as needed. When a user wishes to open the stopper, the strip needs to be moved, in particular, it needs to be tilted relative to the skirt by rupturing the said frangible bridges, as needed, and by deforming the non-frangible link connecting the skirt and the strip, whereby this link is realized in the form of a strand projecting from the external lateral surface of the skirt. The movement of the strip releases from the skirt the inside of the strip allowing the user to manually seize it and pull it along with the strip and the skirt, until unsnapping the latter from the neck of the container. The stopper according to the invention is thus especially easy to open, even in the presence of frangible tamper-evident means, which stopper can subsequently be snapped on again just as easily. Moreover, by making the release of the stopper easy and practical, the opening strip indirectly allows for simplifying the design of the container neck, which can thus be provided as short and economical. Moreover, the presence of the opening strip outside the skirt is, of course, compatible with internal arrangements at the skirt, as regards the tightness of the neck closure by the stopper.

Also, according to the invention, the opening strip in its folded-down position is arranged, at least for the portion connected to the skirt by the strand, at the axial level of the bottom of the skirt, whereby the relevant lower ends of the strip and the skirt are flush with one another, at least in their relevant portion connected by the strand, i.e., the introduction of a tampering tool at the base of the skirt for the purpose of locally unsnapping the latter, particularly in its portion connected to the strip by the strand causes the strand and/or strip to deteriorate. The anti-tampering safety of the stopper according to the invention is therefore high. In addition, the opening strip may advantageously have other anti-tampering arrangements, making it possible to further limit the risk of malicious opening of the stopper without leaving a consistent trace. In any case, the stopper according to the invention is advantageously manufactured in a simple and economical way by molding a plastic material. This stopper is also easily placed on a container neck to be stoppered, typically by using high-speed gripping machines along bottling lines, whereby these machines advantageously are not limited by having to grab the stopper according to a specific angular orientation, in that these machines can grab the upper end part of the skirt intended to be turned opposite the container by cooperating with the outside circular profile of this end part without being hindered by the presence of the opening strip.

Additional advantageous features of the stopper according to the invention are specified in the dependent claims.

BRIEF DESCRIPTION OF THE DRAWINGS

The invention will be better understood by reading the below description, provided merely by way of example and with reference to the drawings, in which:

FIG. 4 is a partial longitudinal section along the plane II in FIG. 1 of the stopper, as well as of a container neck around which, the not-yet opened stopper has been placed; and.

DETAILED DESCRIPTION

Figure 2:
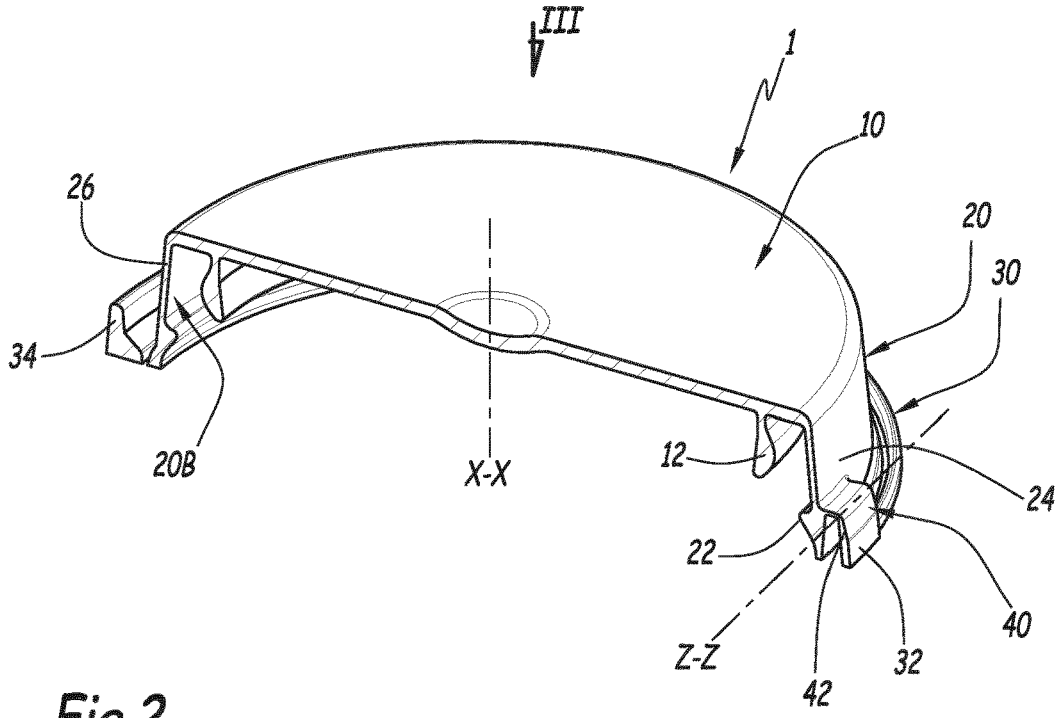
FIG. 2 is a perspective view of a longitudinal half-section of the stopper, along the section plane II indicated in FIG. 1.
Figure 3:
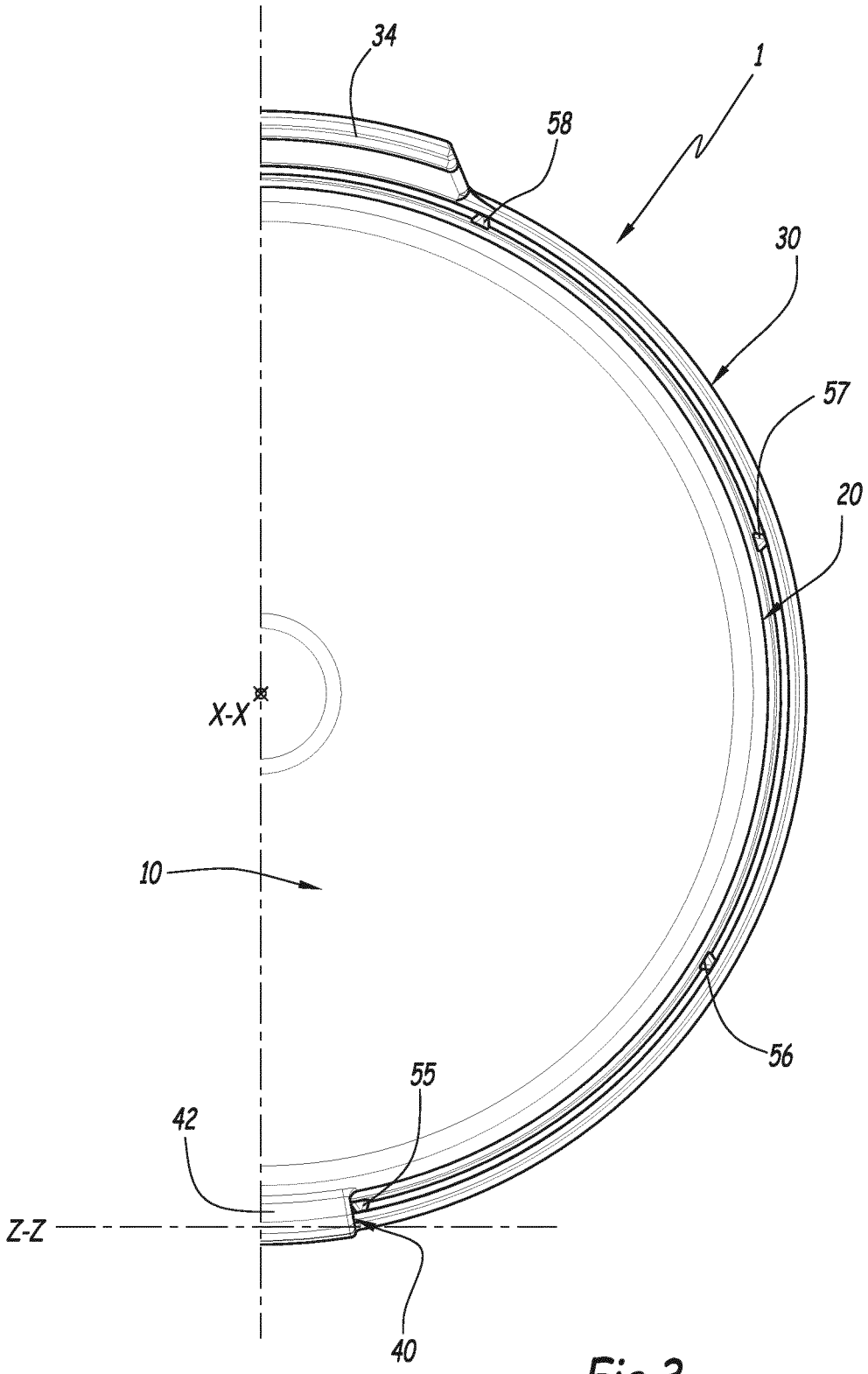
FIG. 3 is an elevational view according to arrow III in FIG. 2.
Figure 4:
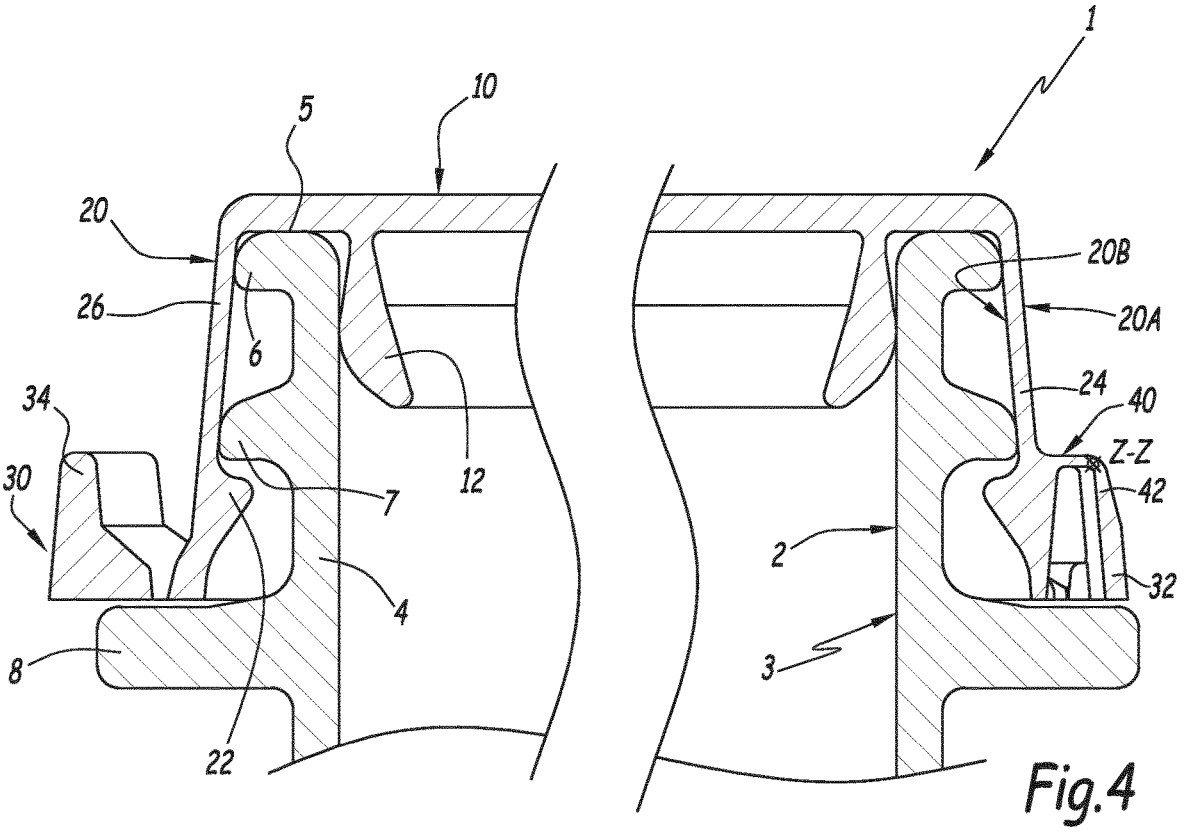
Figure 5:
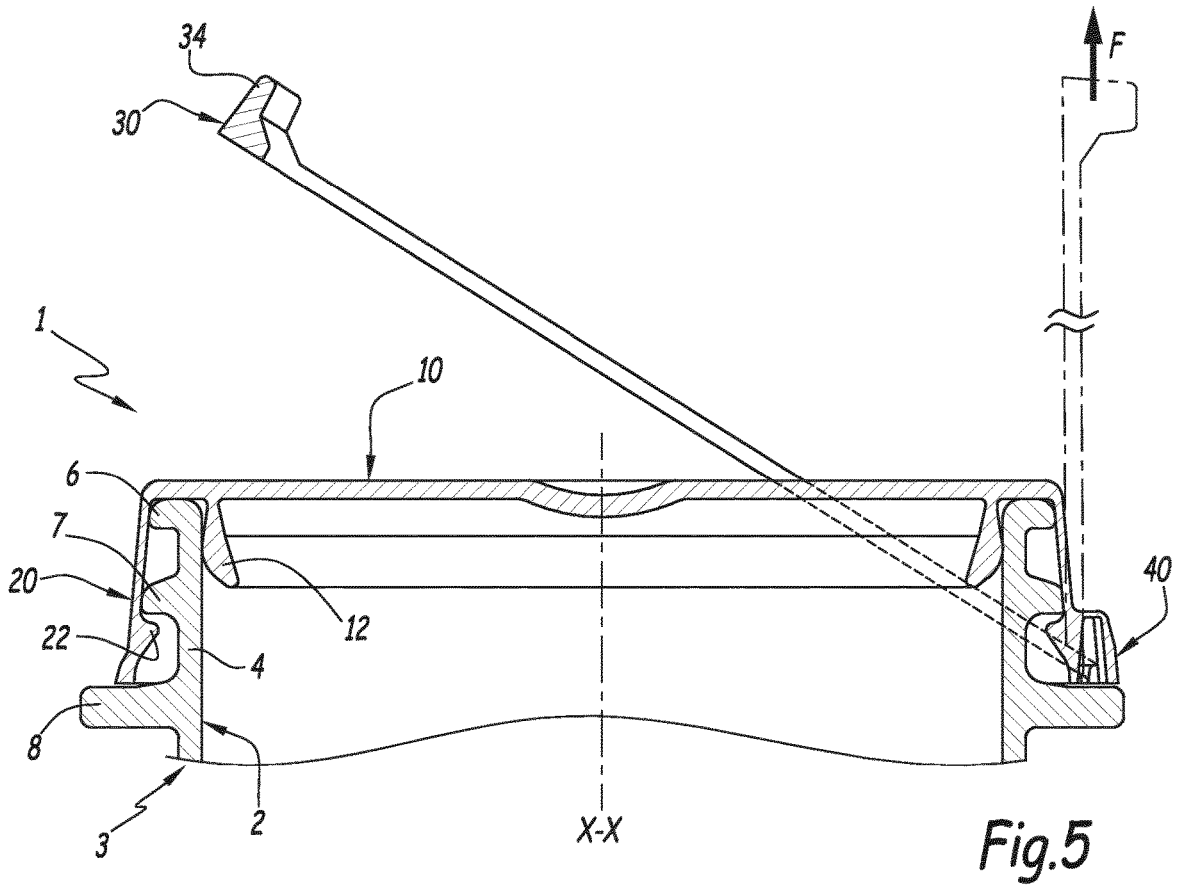
FIG. 5 is a longitudinal section similar to FIG. 4, showing the stopper, as it is being opened.

FIGS. 1-5 show a stopper 1 adapted to be removably fastened and snapped onto a neck 2 of a container 3, the stopper 1 being generally referred to as a "snap-on stopper." In practice, the neck 2 is either made of the same material as the remainder of the container 3, especially if the latter is a glass or plastic bottle, as in FIGS. 4 and 5, or adapted to be permanently secured to a wall of the container, at the level of an opening through this wall.

Overall, the stopper 1 and the neck 2 have essentially tubular shapes, whose center longitudinal axes are substantially coincident, referenced as X-X, when the stopper is fastened on the neck, as in FIGS. 4 and 5. For the sake of convenience, in the remainder of the description, the terms "upper" and "top" correspond to a direction that is generally parallel to the X-X axis and extending from the body of the container 3 toward its neck 2, i.e., a direction toward the upper part of FIGS. 1, 2, 4 and 5, while the terms "lower" and "bottom" refer to the opposite direction.

The neck 2 comprises a tubular body 4 with a circular base, with the axis X-X. As shown in FIGS. 4 and 5, the body 4 defines, at its upper end, a lip 5, from which the liquid held in the container or, more generally, the contents of the container is intended to be poured. On the external surface of the body 4, the neck 2 comprises, at its upper end, a brim 6 and, in its current part, a boss 7, as well as, at its lower end, a flange 8. This brim 6, boss 7 and flange 8, all three, extend radially outward from the body 4.

The stopper 1 is made of a semi-rigid plastic material, such as polypropylene or polyethylene, preferably shaped by molding.

The stopper 1, considered snapped onto the neck 2, is open at its lower end and closed at its upper end by an end wall 10 extending across, or even perpendicular to the X-X axis. The stopper 1 also comprises a tubular skirt 20, centered on the X-X axis and extending axially downward from the external periphery of the end wall 10. In the example shown in the figures, the skirt 20 has an external lateral surface 20A and an inner lateral surface 20B, both with a circular base centered on the X-X axis. As shown in FIGS. 4 and 5, when the stopper 1 is snapped onto the neck 2, the end wall 10 extends over and across this neck, while the skirt 20 surrounds externally the body 4 of the neck, its surface 20B radially facing the latter.

In the exemplary embodiment shown in the figures, the skirt 20 is dimensioned in length, i.e., along the X-X axis, such that its lower end is in close proximity to, or even bearing against, allowing for play, the upper surface of the flange 8 of the neck 2, when the stopper 1 is snapped onto this neck.

The skirt 20 is provided internally with snapping means 22, in the embodiment consisting of a snapping band 22 in the form of a bulge of material extending radially inward from the inner lateral surface 20B of the skirt. Snapping the stopper 1 onto the neck 2 consists in jamming the band 22 under the boss 7 by engaging the upper part of the band 22 with the lower part of the boss 7, while the end wall 10 is pressed downward against the lip 5 of the neck, as shown in FIGS. 4 and 5.

Conversely, unsnapping the stopper 1 consists in disengaging the band 22 from the boss 7 by applying an upwardly directed force to the skirt 20, enough to make the boss 7 clear the band 22, bypassing the latter externally, by locally deforming the wall of the skirt radially toward the outside.

In practice, the axial position of the snapping band 22 is not limiting for the invention, as long as this position takes into account the position of the boss 7 of the neck 2, with which the band jammingly engages, so as to snap the skirt around the neck. Moreover, as a variant (not shown), the boss 7 and the brim 6 may be made in the form of the same bulge of material, projecting outside the upper end of the body 4 of the neck 2.

As an optional arrangement for sealing the closure of the neck 2 by the stopper 1, when the latter is snapped on, the stopper 1 comprises a lip 12, which extends axially downward from the end wall 10, in a centered way on the X-X axis inside the skirt 20, i.e., when the stopper is snapped onto the neck 2, as in FIGS. 4 and 5, the lip 12 rests sealingly against the inside surface of the body 4 of the neck. Also, as an optional arrangement for sealing the neck closure, the upper end of the skirt 20 is slightly constricted, at least internally, in relation to the remainder of the skirt 20, such as to surround the brim 6 of the neck 2 in an adjusted manner, i.e., in this way, when the stopper 1 is snapped onto the neck 2, the upper end of the inner lateral surface 20B of the skirt 20 is sealingly resting against the external periphery of the brim 6 of the neck.

The stopper 1 further comprises an opening strip 30. This strip 30 has an annular shape, which in the exemplary embodiment shown here has a circular base. The profile of the inner surface of the strip 30 is slightly larger than the profile of the external lateral surface 20A of the skirt 20, in other words, the strip 30 is dimensioned, such that it may be arranged coaxially and around the skirt 20, providing an annular space between the inner surface of the strip 30 and the external surface 20A of the skirt 20, as can be seen in FIG. 3. In practice, the strip 30 has a height, i.e., a dimension along its central axis, which, over the majority of the periphery of the strip, is less than half, or even a third, or a quarter of the height of the skirt 20.

The strip 30 is permanently connected to the skirt 20 by a strand 40 of a non-frangible material.

Figure 1:
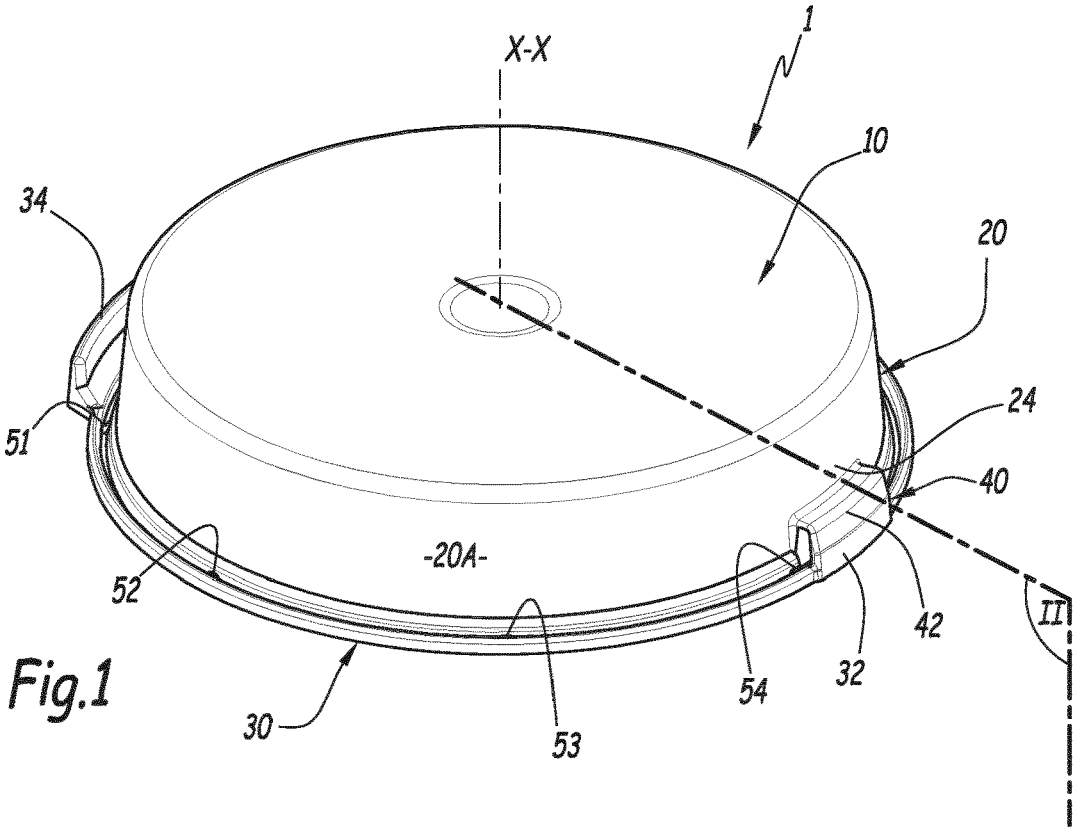
FIG. 1 is a perspective view of a stopper according to the invention.

As can be seen in FIGS. 1-3, this strand 40 extends over limited peripheral portions of the skirt 20 and the strip 30, i.e., a peripheral portion 24 of the skirt 20, which connects the remainder of the skirt to the strand 40, and a peripheral portion 32 of the strip 30, which connects the remainder of the strip to the strand 40.

The strand 40 is designed to be deformed in a flexible manner and without breaking in order to modify the relative positioning between the strip 30 and the skirt 20. Thus, the strip 30 is movable with respect to the skirt 20, between:

- a folded-down position, which is shown in FIGS. 1 to 4, and in which the strip 30 extends generally horizontally and surrounds coaxially the skirt 20, in a position radially facing the external lateral surface 20A of the skirt, and
- a raised position, which is shown in FIG. 5, and in which the strip 30 extends generally inclined relative to the horizontal and, in fact, generally vertically, as shown diagrammatically by dot-dash lines in FIG. 5, such that the inside of the strip 30 is mostly or even fully detached from the skirt 20.

It is obvious that when the strip 30 is in the raised position, the inside of this strip, which is substantially, if not entirely, uncovered by the skirt 20, as opposed to when the strip is in the folded-down position, is freely accessible by one or more fingers of a user's hand in order to wrap the strip around these fingers, due to the appropriate dimensioning of the inside diameter of the strip 30, i.e., the user's hand can therefore grab the strip 30 firmly and without difficulty and subsequently pull it upward, in particular substantially parallel to the X-X axis, as indicated by the arrow F in FIG. 5, thus at the same time pulling the skirt 20 along, as it is connected to the strip 30 by the strand 40, until the skirt unsnaps and thereby releases the stopper 1 from the neck 2.

Of course, moving the strip 30 from its folded-down position to its raised position with respect to the skirt 20 is reversible by the reverse deformation of the strand 40. From a kinematic point of view, moving the strip 30 between its folded-up and raised positions is akin to being tilted about a geometrical Z-Z axis, orthoradial to the X-X axis and situated at the level of the strand 40, such that the latter may be referred to as a tilting hinge.

According to an optional arrangement, which is advantageously implemented in the exemplary embodiment shown in the figures, the strip 30 is provided with a manually actuated tab 34. This tab extends radially projecting outward from the annular body of the strip 30. As is clearly visible in FIGS. 1 and 3, this tab 34 extends along the periphery of the strip 30, but only over a limited portion thereof, whereby this portion is diametrically opposite the peripheral portion 32 associated with the strand 40.

In practice, the specific geometry of the tab 34 is not limiting for the invention, as long as this tab, due to its external projecting arrangement, allows the user to easily grab the strip in the folded-down position and pulling it along toward the raised position, in particular by allowing the user to catch the strip 30 with the tip of the fingers at the peripheral level opposite the strand 40.

According to another optional and particularly advantageous arrangement, the stopper 1, in connection with its opening strip 30, incorporates tamper-evident means, which is designed to break, when the stopper 1 is opened for the first time, thereby providing an appropriate indication [or: warning] to the user. For this purpose, the stopper 1 comprises frangible bridges, which are spaced around the X-X axis and which, in the exemplary embodiment shown in the figures, are provided in eight instances, referred to as 51-58, respectively. As is clearly visible in FIGS. 1 and 3, each of these frangible bridges 51-58 is provided in order to connect the skirt 20 and the strip 30 in the folded position to one another before to being broken, i.e., before a first opening of the stopper 1, more precisely in order to connect the external lateral surface 20A of the skirt to the inner surface of the strip 30 in the folded-down position. These frangible bridges 51-58 therefore occupy confined portions of the annular space arranged radially by the skirt 20 and the strip 30 in the folded-down position. In practice, the frangible bridges 51-58 are spaced around the X-X axis, outside the peripheral portions 24 and 32 of the skirt 20 and the strip 30, respectively. It is understood that when the stopper is first opened, the change of the strip 30 from its folded-down to its raised position causes the frangible bridges 51-58 to break, thereby providing the user with a visual indication that the strip 30 was removed from its folded-down position, prior to opening the stopper 1.

Advantageously, at least one of the frangible bridges 51-58, following the periphery of the skirt 20 and the strip 30 in the folded position, is situated immediately at one side of the strand 40, and being contiguous therewith. Preferably, these are two of the frangible bridges 51-58, namely the bridges referred to as 54 and 55 in the figures, which, depending on the periphery of the skirt 20 and the strip 30 in the folded-down position, are situated immediately on either side of the strand 40, and contiguous therewith. This immediate proximity, along the periphery of the skirt and the strip, between these bridges 54 and 55 and the strand 40 is clearly visible in FIG. 3, as regards bridge 55.

In this way, any attempt to tamper with the stopper 1 aimed at unsnapping the skirt 20 locally, in particular by means of a tool, causes the rupture of one or more of the bridges 51-58. Moreover, when such tampering is attempted at the peripheral level of the strand 40, either one or both of the frangible bridges 54 and 55 will break.

As for the embodiment of the strand 40, it is not limiting to the invention, as long as it permits a flexible and non-destructive deformation of the strand in order to move the opening strip 30 between the folded-down and raised positions, as explained above. In practice, the strand 40 extends and projects outward from the external lateral surface 20A of the skirt 20, covering and/or bordering a peripheral portion of the annular space arranged radially between the skirt 20 and the belt 30 in the folded-down position, namely the portion of this space situated around the X-X axis at the level of the peripheral portions 24 and 32 of the skirt and the strip. According to one embodiment, which is effective and easy to manufacture, especially by molding, the strand 40 extends upwardly from the upper end edge of the strip 30. This embodiment makes it possible to envision the strand in a slimmer form, i.e., in the form of a web 42 covering and exposing the aforesaid portion of the annular space arranged radially between the skirt 20 and the strip 30. In the exemplary embodiment considered here, this web 42 is bent downward, exclusively connecting the external lateral surface 20A of the skirt 20 and the upper end edge of the strip 30 with one another.

Regardless of its geometrical characteristics, this web 42, due to its presence, reinforces the anti-tampering safety of the stopper 1, which has a tendency to tear under the action of any tool being inserted at the peripheral level of the strand 40 between the strip 30 and the skirt 20 attempting to slide it inside the latter, or by softening the junction between the portion 32 and the skirt 20, such that if a thrust is exerted on the portion 32 in order to attempt to unsnap the skirt 20, either one or both of the bridges 54 and 55 will break first and make the tampering obvious.

According to one advantageous arrangement, which is implemented in the embodiment shown in the figures, the opening strip 30, when in the folded position, is situated substantially at the axial level of the lower end of the skirt 20. More specifically, as can be seen in FIG. 4, the lower end of the strip 30 radially faces the lower end of the skirt 20, such that the relevant lower ends of the strip 30 and the skirt 20 are flush with one another, by being situated, when the stopper 1 is snapped onto the neck 2, at the axial level, allowing for play, at the top surface of the flange 8; hence, the anti-tamper security for stopper 1 is reinforced, making it impossible, except by impairing the strip 30, to insert a tamper tool between the 8 flange and the bottom end of the skirt 20.

In a variant not shown, the axial alignment of the relevant lower ends of the skirt 20 and the strip 30 may be limited to their peripheral portions 24 and 32 in order to reinforce anti-tampering safety exclusively at the peripheral level of the strand 40, while allowing the remainder of the strip 30 to cover axial levels other than that of the lower end of the skirt and along the axial extent of the external lateral surface 20A of the skirt 20, i.e., in particular, in its peripheral portion diametrically opposite its peripheral portion 32, this strip may extend around the skirt 20 at substantially half the axial height of the external surface 20A, thereby providing a free space diametrically opposite the strand 40, situated axially between the flange 8 and the strip 30 in order to make it easier for a user to grab the strip 30 in the folded-down position.

According to an especially advantageous dimensioning of the opening strip, the strand 40 and the tab 34, these elements allow the skirt 20 to emerge, in the upper portion, above them, when the strip 30 is in the folded-down position. Thus, as can be seen in FIGS. 2 and 4, the skirt 20 includes an upper end portion 26, which connects the end wall 10 to the remainder of the skirt 20, i.e., the external lateral surface 20A of the skirt 20 includes a portion delimited by this upper end portion 26, which is not radially facing the strip 30 in the folded-down position, the strand 40 or the tab 34. This upper end portion 26 of the skirt 20 therefore has the advantage of being easily and efficiently grasped by a gripping machine for the stopper 1 in order to initially place this stopper around the neck 2 to be stoppered. In fact, this upper terminal portion 26 has a circular external profile which is free from any obstacle or relief over its whole periphery, which would disturb the gripping of this skirt by the aforesaid machines.

Finally, the various arrangements and variants of the stopper 1 described thus far are also possible. For example:

- rather than extending uninterruptedly over the entire inner periphery of the skirt 20, the snap-on strip 22 may be interrupted one or more times, thus consisting of several distinct snaps spaced along the inner periphery of the skirt 20, and according to the angular positioning of this or these interruptions around the X-X axis, in particular relative to the peripheral levels of the strand 40 and the tab 34, the snapping and/or unsnapping of the skirt 20 may be made less or, on the contrary, more resistant;
- rather than being realized as a thin web, such as the web 42, the strand 40 may be made in a solid form, in particular covering the whole space arranged radially between the relevant peripheral portions 24 and 32 of the skirt 20 and the strip 30; and/or
- in the example shown in FIGS. 4 and 5, the body 4 of the neck 2 is externally smooth between the edge 6 and the boss 7; in a variant not shown, this part of the body 4 may be threaded, with the understanding that this threading will not be used to fasten the stopper 1 on the neck 2 by screwing, and that the presence of such a thread would not be cumbersome, when placing the snap-on stopper 1.

The invention claimed is:

1. A stopper for a container neck, comprising:

a skirt having a generally tubular shape and being centered on an axis, the skirt being adapted to surround a neck of a container, and being provided internally with a band adapted to fasten the skirt to the neck in a removable manner by engaging with an external projecting boss of the neck of the container; and an opening strip having a generally annular shape and including a peripheral portion that is connected to a peripheral portion of the skirt, the strip being movable relative to the skirt between:

a first position, in which the strip surrounds an external lateral surface of the skin, by providing an annular space radially between the external lateral surface of the skirt and an inner surface of the strip; and a second position, in which the inside of the strip is substantially detached from the skirt in order to enable the strip to be manually grasped so that the skirt is removed from the neck, wherein the peripheral portion of the skirt and the peripheral portion of the strip are connected by a strand protruding from at least the external lateral surface of the skirt, the strand comprising a web that covers a free portion of the annular space and is arranged radially between the peripheral portions of the skirt and of the strip, and the strand being designed to be deformed when the strip is moved between the first and second positions, and wherein when the peripheral portion of the skirt and the peripheral portion of the strip are in the first position, corresponding lower ends of the skirt and the strip are aligned with one another.

2. A stopper according to claim 1, wherein the axis is a first axis, and the strip is movable relative to the skirt between the first and second positions by tilting the strip around a second axis that is substantially orthogonal to the first axis.

3. A stopper according to one of claim 1, wherein the strip is dimensioned, such that when the strip is in the second position, the strip is wrapped around at least one finger of a user's hand.

4. A stopper according to claim 1, wherein the stopper includes bridges which, before first opening the stopper, connect the skirt and the strip with one another in a first position outside the peripheral portions of the skirt and of the strip, the bridges being spaced around the axis of the skirt and covering portions of the annular space and which, when first opening the stopper, are designed to be broken, when the strip moves from the first position to the second position.

5. A stopper according to claim 4, wherein at least one of the bridges is situated along the periphery of the skirt and the periphery of the strip in the first position immediately to one side of the strand and being integral with the strand.

6. A stopper according to claim 1, wherein the strand extends from at least the upper end edge of the strip.

7. A stopper according to any of claim 1, wherein the strand fully covers a portion of the annular space and is arranged radially between the peripheral portions of the skirt and of the strip.

8. A stopper according to claim 1, wherein the strip has an axial dimension which is less than half the axial dimension of the skirt over the majority of the periphery of the strip.

9. A stopper according to claim 8, wherein the strip has an axial dimension that is less than a third of the axial dimension of the skirt over the majority of the periphery of the strip.

10. A stopper according to claim 9, wherein the strip has an axial dimension that is less than a quarter of the axial dimension of the skirt over the majority of the periphery of the strip.

11. A stopper according to claim 1, wherein the stopper further comprises includes an end wall from which the skirt extends substantially along the axis, and the skirt includes an upper end portion, which connects the rest of the skirt to the end wall, and which is not radially facing either the strip or the strand.

12. A stopper according to claim 1, wherein the strip, opposite the strand is provided with a protruding external tab along the periphery of the strip for manually gripping the strip in a first position and pulling the strip toward the second position.

13. A stopper according to claim 12, wherein the upper end part of the skirt is not radially facing the tab.

14. A stopper according claim 1, wherein, in the opposite position of the peripheral portion of the strip, the strip, in the first position, extends around the skirt substantially at a half axial height from the external lateral surface of the skirt.

15. A stopper for a container neck, comprising:

a generally tubular skirt centered on a first axis and being configured to surround a neck of a container, the skirt having a band protruding inwards and being configured to fasten the skirt to the neck by engaging with a boss protruding outwards from the neck; and a generally annular strip being centered on the axis and having a peripheral portion that is connected to a peripheral portion of the skirt, the strip being movable relative to the skirt between:

a first position, in which the strip surrounds an external lateral surface of the skirt, by providing an annular space radially between the external lateral surface of the skirt and an inner surface of the strip; and a second position, in which the inside of the strip is substantially detached from the skirt to enable the strip to be manually grasped so that the skirt is removed from the neck, wherein the strip is movable relative to the skirt between the first and second positions by tilting the strip around a second axis that is substantially orthogonal to the first axis, and wherein the peripheral portion of the skirt and the peripheral portion of the strip are connected by a strand protruding from at least the external lateral surface of the skirt, the strand being designed to be deformed, when the strip is moved between the first and second positions.

16. The stopper according to one of claim 15, wherein when the peripheral portion of the skirt and the peripheral portion of the strip are in the first position, corresponding lower ends of the skirt and the strip are aligned with one another.

17. The stopper according to claim 15, wherein the stopper includes bridges which, before first opening the stopper, connect the skirt and the strip with one another in a first position outside the peripheral portions of the skirt and of the strip, the bridges being spaced around the axis of the skirt and covering portions of the annular space and which, when first opening the stopper, are designed to be broken, when the strip moves from the first position to the second position.

18. The stopper according to claim 17, wherein at least one of the bridges is situated along the periphery of the skirt and the periphery of the strip in the first position immediately to one side of the strand and being integral with the strand.

* * * * *